US005882587A

United States Patent [19]

Okamoto et al.

[11] Patent Number: 5,882,587

[45] Date of Patent: Mar. 16, 1999

[54] LEAD ALLOY USED FOR SLIDING BEARING

[75] Inventors: Shinichi Okamoto; Takashi Tomikawa; Shigeyuki Suga, all of Aichi, Japan

[73] Assignee: Taiho Kogyo Co., Ltd., Toyota, Japan

[21] Appl. No.: 867,402

[22] Filed: Jun. 2, 1997

Related U.S. Application Data

[63] Continuation of Ser. No. 559,177, Nov. 13, 1995, abandoned, which is a continuation of Ser. No. 325,408, filed as PCT/JP93/00278 Mar. 4, 1993, abandoned.

[51] Int. Cl.[6] ..... C22C 11/06

[52] U.S. Cl. ..... 420/570; 420/573; 384/912; 428/645; 428/941

[58] Field of Search ..... 420/570, 573, 420/563; 428/645, 452, 941; 384/912

[56] References Cited

U.S. PATENT DOCUMENTS

| | | | |
|---|---|---|---|
| 4,309,064 | 1/1982 | Fukuoka et al. | 308/237 R |
| 4,832,801 | 5/1989 | Mori | 204/37.3 |
| 4,927,715 | 5/1990 | Mori | 428/645 |
| 4,937,149 | 6/1990 | Mori | 428/645 |

FOREIGN PATENT DOCUMENTS

| | | | |
|---|---|---|---|
| 134234 | 10/1946 | Australia . | |
| 487310 | 10/1952 | Canada | 428/645 |
| 61-266544 | 11/1986 | Japan . | |
| 62-74097 | 4/1987 | Japan . | |

*Primary Examiner*—Sikyin Ip
*Attorney, Agent, or Firm*—Armstrong, Westerman, Hattori, McLeland & Naughton

[57] ABSTRACT

An overlay alloy for sliding bearing is deposited on a lining by plating and consists of from 2 to less than 5% of tin, from 0.05 to 10% of indium, from 0.05 to 5% of copper, the balance consisting of lead and unavoidable compound. Seizure at high speed travel is almost completely eliminated.

18 Claims, No Drawings

LEAD ALLOY USED FOR SLIDING BEARING

This application is a continuation of application Ser. No. 08/559,177 filed Nov. 13, 1995, now abandoned which is a continuation of application Ser. No. 08/325,408 filed as PCT/JP93/00278, Mar. 4, 1993, now abandoned.

TECHNICAL FIELD

The present invention relates to a lead alloy used for a sliding bearing, and more particularly, to a lead-alloy overlay which is deposited by plating on the sliding bearing alloy of an internal-combustion-engine bearing. Such sliding bearing alloy is for example a copper-lead alloy sold under the tradename Kelmet or an aluminum-alloy for use as a bearing.

PRIOR ART

As is well known, a sliding bearing used in an internal combustion engine is produced by depositing Kelmet or aluminum alloy on a steel sheet, which has been shaped in the form of a cylindrical bushing, a half bearing or an annular bearing, (the resultant product is referred to as "lining"), and, then by depositing an overlay on the Kelmet or the like by plating. The main functions of the overlay alloy are as follows. The overlay alloy enhances the compatibility between a bearing and a shaft, such as a crank shaft, and hence eliminates the contact failure of a shaft and a bearing which results from shaft misalignment caused by the machining inaccuracy of the housing of an internal combustion engine. The overlay also embeds thereinto foreign matter incorporated into the lubricating oil.

The present applicant has already filed the following applications of the lead-alloy for a sliding bearing (overlay).

(1) Japanese Examined Patent Publication No. Sho 60-41, 695: a lead alloy which contains from 5 to 20% of tin, from 0.05 to 10% of indium, and from 0.05 to 5% of copper, the balance consisting of lead and unavoidable impurities. It is alleged in this publication that, since the ternary Pb alloy for the overlay prior to this application lacked mainly in the wear-resistance, copper is added as the fourth element so as to improve wear-resistance and in turn to enhance the overall performance of the overlay.

(2) Japanese Unexamined Patent Publication No. Sho 59-205,442: a lead alloy which contains from 2 to 20% of tin, from more than 10 to 15% of indium, and from 0.05 to 5% of copper, the balance consisting of lead and unavoidable impurities. It is alleged in this publication that the indium content in this alloy can be increased to an amount greater than that in a Pb alloy (1), so as to decrease the wetting angle of the lubricating oil on the overlay surface, and hence to improve simultaneously wear-resistance and compatibility. As a result, the overall performance of an overlay is enhanced.

(3) Japanese Examined Patent Publication No. Hei 2-39, 572: an alloy which contains from 2 to 20% of tin, from 0.05 to 15% of indium, and from 0.01 to less than 0.05% of copper, the balance consisting of lead and unavoidable impurities. It is alleged in this publication that, the copper content in this alloy can be decreased to less than that in the lead alloys (1) and (2), so as to densify the plating structure and hence to improve wear resistance. As a result, the overall performance of an overlay is enhanced.

Overlays, whose compositions fall within the ranges disclosed in every one of the above publications (1), (2) and (3), are used in the internal combustion engines sold in the market.

Nevertheless, insufficient bearing performance has been pointed out in recent years, resulting in seizure of bearings which occurred in certain types of automobiles traveling at high speed. When the bearings which incurred the trouble were subjected to observation, it was recognized that a portion of the overlays where seizure occurred, was melted due to local temperature-rise, and, further, the overlay peeled at the melted portion.

Conventionally, it has been assumed that the temperature of lubricating oil is approximately 140° C. (publication (1), column 8, line 27) or approximately 120° C. (publication (3), column 7, line 39). Since these temperature levels are considerably lower than the melting point of Pb alloys, it had been assumed that the overlay would not melt. Contrary to this assumption, a melted and solidified structure (with Sn dispersed in the Pb matrix), which was clearly distinct from the plating structure (particles of Pb, Sn, In, Cu and the like dispersed in the structure virtually unnoticed, and, a trace of thermal diffusion partly observed was formed on the bearing which seized when used on automobiles traveling at high speed. It is not possible to specify the reason as one of the following: melting of a part of the dispersed particles, particularly tin particles; local melting of the Pb alloy which has a Pb—Sn—In—Cu composition. However, since there is a cause-and-effect relationship between the melting and the seizure, there arose a necessity to take a countermeasure to prevent the melting.

DISCLOSURE OF INVENTION

It is therefore an object of the present invention to provide a lead alloy for a sliding bearing exhibiting improved performance at high-speed travel.

A lead alloy for a sliding bearing according to the present invention is characterized in that it contains, by weight percentage, from 2 to less than 5% of tin, from 0.05 to 10% of indium, and from 0.05 to 5% of copper, the balance consisting of lead and unavoidable impurities. Therefore, the present invention provides a lower tin content compared with that of the known alloy (1), a lower indium content compared with that of the known alloy (2), and a higher copper content compared with that of the known alloy (3). Because of the component limitations as described above, the sliding-bearing used at high-speed travel and high rotation exhibits performance improved over the known alloys (1), (2) and (3).

The reasons for limiting the composition of the present invention are now described.

Tin enhances the compatibility, corrosion resistance, fatigue resistance, wear resistance and the like of an overlay. This effect is not attained, when the tin content is less than 2%. On the other hand, when the tin content is 5% or more, tin is liable to form a Ni—Sn compound when tin diffuses into the Ni plating layer deposited as an intermediate layer on the Kelmet surface or the like. When this compound layer becomes thick, the overlay is liable to peel off.

Furthermore, when the tin content is 5% or more, the melting point of the lead alloy lowers so that melting and overlay seizure under high speed operation become liable to occur. The melting point of the Pb alloy or overlay herein is not that of the ingot but that of the overlay alloy produced by plating. The overlay alloy produced by plating does not have a structure which is predicted from the phase diagram, as the ingot alloy has, but has a particle-dispersion structure. The melting point of the plated overlay alloy seems to be slightly different from the one predicted from the phase diagram. The present inventors investigated the relationship between the measured melting point, the seizure resistance and the fatigue resistance, and then discovered that the tin content must be limited to less than 5% to improve these properties. When the tin content is less than 5%, the tin phases uniformly and finely disperse, and thus formation of coarse tin phases is prevented. Finely dispersed tin phases also seem to be also effective for suppressing the tin from melting which leads to seizure. A preferable tin content is from 3 to 4%.

The prior art (1) describes that less than 5% of tin is not effective for enhancing the corrosion resistance. However, in the prior art (1), no examples are given showing the properties, such as seizure resistance, of a Pb alloy having a low tin composition-range. In fact, when an inventive alloy, i.e., a comparative alloy of prior art (1) with less than 5% of tin, is tested at a low-speed rotation, poor corrosion resistance is noted, and no superiority in the seizure resistance and the like is observed. It can therefore be concluded from this fact that the melting of the overlay, which does not occur at low-speed rotation, will occur at high-speed rotation.

Indium enhances the compatibility and corrosion resistance. These effects are not realized at an indium content of less than 0.05%. On the other hand, when the indium content exceeds 10%, the melting point of the overlay is so lowered to the point that the above described detrimental phenomena occur. The indium content must therefore be from 0.05 to 10% in the present invention. A preferable indium content is from 0.5 to 8%. A more preferable indium content is from 7 to 8%.

It is described in the prior art (2) that the affinity to oil is not improved at an indium content of 10% or less, and, hence the effect of indium addition, i.e., improvement of compatibility without impairing the wear resistance, is not obtained. And, in the prior art (2), a comparative example of an alloy with 10% or less of indium as well as an example of the low tin composition, 6% Sn (Table 24, No.25) are shown. However, no comparative example, which corresponds to the present invention with 10% or less of indium and less than 5% of tin, is shown. In fact, when the inventive alloy, i.e., an alloy setting the indium content of the prior art alloy (2) to 10% or less, is tested at a low-speed rotation, failure in compatibility and wear resistance is not observed. Also, in the case of low-speed rotation, a considerable difference in the seizure resistance and the like is not observed within and beyond the border of 5% of tin. It can therefore be said from this fact that the melting of the overlay, which does not occur at low-speed rotation, occurs at high-speed rotation.

Copper promotes refining of the tin phases and forms a Cu—Sn intermetallic compound, with the result that the diffusion of tin is prevented, melting of tin becomes difficult, and the fatigue resistance is enhanced. In order to attain these effects, addition of 0.05% or more of copper is necessary. On the other hand, when amount of copper added exceeds 5%, the overlay hardens and the plating structure coarsens, with the result that compatibility, seizure resistance and fatigue resistance degrade. A preferable copper content is from 0.5 to 4%. A more preferable copper content is from 0.5 to 1.5%.

It is described in the prior art (3) that, when the copper content is 0.05% or more, the plating structure fails in the points of homogenity and density, and the fatigue resistance is degraded. With regard to a comparative example with a copper content of 0.05% or more, an alloy with 7% of Sn and 5% of In is shown (Table 1). However, no comparative example with 0.05% or more of Cu and less than 5% of tin, corresponding to the present inventive alloy-composition, is shown. In fact, when an inventive alloy, i.e., an alloy of the prior art (3), whose tin content is set at 5% or less, is tested at low-speed rotation, no improvement in the fatigue resistance is appreciated. Also, in the case of low-speed rotation, a considerable difference in the seizure resistance and the like is not noticed within and beyond the limit of 5% of tin. It can therefore be said from this fact that the diffusion of tin, which does not raise a problem at low-speed rotation, raises a problem at a high-speed rotation.

The method for producing the overlay alloy according to the present invention is basically quarternary plating on a lining as described in the prior art (1)–(3). Preferably, a ternary Pb—Sn—Cu alloy plating is obtained by adjusting the plating time and using a known plating bath which contains from 150 to 200 g/l of lead borofluoride, from 5 to 15 g/l of tin borofluoride, from 1 to 3 g/l of copper borofluoride, approximately 2 g/l of gelatine, and approximately 2 g/l of hydroquinone. Indium plating is then carried out by flash plating or alkaline cyanide bath, which are also known. Finally, diffusion is carried out between the In layer and the ternary Pb—Sn—Cu plating layer. The thickness of the overlay is from 8 to 16 $\mu$m depending upon the conditions of use. The diffusion temperature and time known in the prior art (1) may be employed The lead alloy for a sliding bearing according to the present invention is characterized in that both seizure resistance and fatigue resistance are improved under high-speed rotational and traveling conditions.

An investigation was made, while keeping the amount of two elements selected from Cu, Sn and In of the Pb alloy constant, and changing the amount of the other element, as to how the melting point of an overlay, seizure load and fatigue strength were influenced by the addition amount of said other element. As a result, it turned out that tin and indium greatly reduce the melting point of an overlay but copper virtually does not exert any influence upon the melting point. A similar influence by these elements is found in the seizure load. That is, the amount of copper greater than the lowest limit of the present invention virtually does not exert any influence upon the seizure load, and, a high level of seizure load is maintained over a broad range of the copper content. 5% or more of tin drastically lowers the seizure load. On the other hand, indium keeps the seizure load almost constant up to an addition of 9%, and, the seizure load decreases at 9% or more of indium. Such a difference in tin and indium seems to be attributable to the facility of diffusion of tin than indium. Somewhat greater than 1% tin and indium enhance the fatigue strength. The two above described properties, i.e., the seizure load and fatigue strength, attained by the present invention, are at the highest level, without sacrificing either one. The high-speed travel or high-speed rotation herein indicates that 6000 rpm or more of the rate of rotation or 16 m/s or more of circumferential speed of the bearing is guaranteed.

The present invention is hereinafter described by way of example.

BEST MODE TO CARRY OUT THE INVENTION

An overlay alloy having a composition of Table 1 was formed on a conventional Kelmet lining (Ni intermediate layer=1–3 microns) by plating and diffusion, so that the overlay has a thickness of 16 microns. The following properties were measured.

(A) Melting point (° C.): The overlay was shaved off from the bearing samples to provide a sample for thermal differential analysis. The temperature, at which endothermic reaction occurred, was measured by the thermal differential analysis meter.

(B) Seizure resistance (Seizure load—kg/cm$^2$): A test was carried out using a 20 ton reciprocating load tester under a condition of 120° C. oil temperature, 5000 rpm rate of rotation and oil grade, SAE 10W30. The load application pattern was breaking in at 100 kg/cm$^2$ for 30 minutes and then increasing the load by 25 kg/cm$^2$ in every 30 minutes.

(C) Fatigue resistance (Fatigue strength—repeating number): A test was carried out using a rotation load tester under a condition of 120° C. oil temperature, 8000 rpm rate of rotation, oil grade, SAE 7.5W30, and 291 kg/cm$^2$ surface pressure.

The test results are shown in Table 1.

TABLE 1

| | Pb | Sn | In | Cu | Melting Point of Overlay | Seizure Resistance | Fatigue Resistance |
|---|---|---|---|---|---|---|---|
| Inventive | | | | | | | |
| 1 | bal | 3 | 0.05 | 1 | 312 | 900 | $1 \times 10^7$ |
| 2 | bal | 3 | 0.1 | 1 | 312 | 900 | $1 \times 10^7$ |
| 3 | bal | 3 | 1 | 1 | 310 | 925 | $1 \times 10^7$ |
| 4 | bal | 3 | 3 | 1 | 303 | 975 | $2 \times 10^7$ |
| 5 | bal | 3 | 5 | 1 | 292 | 975 | $3 \times 10^7$ |
| 6 | bal | 3 | 7 | 1 | 284 | 975 | $3 \times 10^7$ |
| 7 | bal | 3 | 8 | 1 | 278 | 950 | $3 \times 10^7$ |
| 8 | bal | 3 | 10 | 1 | 268 | 925 | $3 \times 10^7$ |
| 9 | bal | 2 | 7 | 1 | 289 | 950 | $1 \times 10^7$ |
| 10 | bal | 2.5 | 7 | 1 | 287 | 950 | $2 \times 10^7$ |
| 11 | bal | 3 | 7 | 1 | 284 | 975 | $3 \times 10^7$ |
| 12 | bal | 4 | 7 | 1 | 277 | 950 | $3 \times 10^7$ |
| 13 | bal | 4.9 | 7 | 1 | 272 | 925 | $3 \times 10^7$ |
| 14 | bal | 3 | 7 | 0.05 | 283 | 900 | $1 \times 10^7$ |
| 15 | bal | 3 | 7 | 0.1 | 283 | 925 | $1 \times 10^7$ |
| 16 | bal | 3 | 7 | 0.5 | 284 | 950 | $2 \times 10^7$ |
| 17 | bal | 3 | 7 | 1.0 | 284 | 975 | $3 \times 10^7$ |
| 18 | bal | 3 | 7 | 2.0 | 285 | 975 | $3 \times 10^7$ |
| 19 | bal | 3 | 7 | 5.0 | 288 | 975 | $1 \times 10^7$ |
| Comparative | | | | | | | |
| 20 | bal | 8 | 6 | 3 | 270 | 700 | $3 \times 10^7$ |
| 21 | bal | 4 | 13 | 1 | 243 | 625 | $3 \times 10^7$ |
| 22 | bal | 8 | 6 | 0.03 | 269 | 700 | $3 \times 10^7$ |
| 23 | bal | 1 | 7 | 1 | 295 | 825 | $2 \times 10^6$ |
| 24 | bal | 3 | 0.01 | 1 | 309 | 800 | $6 \times 10^6$ |
| 25 | bal | 3 | 7 | 6 | 287 | 975 | $5 \times 10^6$ |

In comparative Example 23, since the tin content is a low 1%, the seizure load and fatigue strength are not excellent. In comparative Examples 20 and 22, although the fatigue strength is high, since the tin content is high, the seizure load is not excellent. In Comparative Example 24, since the indium is low at 0.01%, the seizure resistance and the fatigue strength are not excellent. In Comparative Example 21, although the fatigue strength is high, since the indium content is high, the seizure load is not excellent. In Comparative Example 22, since the copper content is low at 0.03%, the seizure load is not excellent. In Comparative Example 25, although the seizure load is high, the fatigue strength is not excellent, because the copper amount is high at 6%.

Contrary to this, the inventive examples exhibit 900 kg/cm$^2$ or more of seizure load and $1\times10^7$ or more of fatigue strength, both of which properties are excellent.

Industrial Applicability

The Pb alloy for a sliding bearing according to the present invention has improved performance under high-speed operation, and therefore, is expected to be employed for racing automobiles and high-performance and high-grade automobiles. Notwithstanding this improved performance, the amount of Sn used, which is considerably more expensive metal than Pb metal, can be reduced, which is also a great advantage.

We claim:

1. A lead alloy used for a sliding bearing of an automobile and having sliding performance at a rotation of 6000 rpm or more, which alloy is deposited on a lining by plating and consists of, by weight percentage, from 2.5 to less than 5% of tin, from 3 to 8% of indium, from 0.5 to 2% of copper, the balance consisting of lead and unavoidable impurities.

2. A lead alloy used for a sliding bearing according to claim 1, wherein the copper content is from 0.5 to 1.5%.

3. A lead alloy used for a sliding bearing according to claim 1, wherein the tin content is from 3 to 4%.

4. A lead alloy used for a sliding bearing according to claim 3, wherein the copper content is from 0.5 to 1.5%.

5. A lead alloy used for a sliding bearing according to claim 4, which is produced by a ternary Pb—Sn—Cu plating, In plating, and diffusion between the Pb—Sn—Cu plating layer and the In plating layer.

6. A lead alloy used for a sliding bearing according to claim 5, wherein the lead alloy has a thickness of from 8 to 16 $\mu$m.

7. A sliding bearing of an automobile and having sliding performance at a rotation of 6000 rpm or more, which comprises a copper-lead layer, an Ni-intermediate layer and an overlay layer, which is deposited on the Ni intermediate layer by plating, said overlay layer consisting of, in weight percentage, from 2.5 to less than 5% of tin, from 3 to 8% of indium, from 0.5 to 2% of copper, the balance consisting of lead and unavoidable impurities, and has a thickness of from 8 to 16 $\mu$m.

8. A sliding bearing according to claim 7, wherein the copper content is from 0.5 to 1.5%.

9. A sliding bearing according to claim 8, wherein the overlay layer is produced by a ternary Pb—Sn—Cu plating, In plating, and diffusion between the Pb—Sn—Cu plating layer and the In plating layer.

10. A sliding bearing according to claim 7, which has a seizure load of 900 kg/cm$^2$ or more and a fatigue strength of $1\times10^7$ or more.

11. A sliding bearing according to claim 7, wherein the tin content is from 3 to 4%.

12. A sliding bearing according to claim 11, wherein the copper content is from 0.5 to 1.5%.

13. A sliding bearing of an automobile and having sliding performance at a rotation of 6000 rpm or more, which comprises an aluminum bearing alloy layer, an Ni-intermediate layer and an overlay layer, which is deposited on the Ni intermediate layer by plating, consists of, in weight percentage, from 2.5 to less than 5% of tin, from 3 to 8% of indium, from 0.5 to 2% of copper, the balance consisting of lead and unavoidable impurities, and has a thickness of from 8 to 16 $\mu$m.

14. A sliding bearing according to claim 13, wherein the tin content is from 3 to 4%.

15. A sliding bearing according to claim 14, wherein the copper content is from 0.5 to 1.5%.

16. A sliding bearing according to claim 13, wherein the copper content is from 0.5 to 1.5%.

17. A sliding bearing according to claim 16, wherein the overlay layer is produced by a ternary Pb—Sn—Cu plating, In plating, and diffusion between the Pb—Sn—Cu plating layer and the In plating layer.

18. A sliding bearing according to claim 13, which has a seizure load of 900 $kg/cm^2$ or more and a fatigue strength of $1\times10^7$ or more.

* * * * *